US005149566A

United States Patent [19]

Morton et al.

[11] Patent Number: 5,149,566

[45] Date of Patent: Sep. 22, 1992

[54] METAL PLATING PROCESS

[75] Inventors: David Morton, Rowlands Gill; Timothy M. Handyside, Newcastle, both of United Kingdom

[73] Assignee: Courtaulds Coatings Limited, United Kingdom

[21] Appl. No.: 412,789

[22] Filed: Sep. 26, 1989

[30] Foreign Application Priority Data

Sep. 27, 1988 [GB] United Kingdom ..... 8822641

[51] Int. Cl.[5] ..... B05D 7/22

[52] U.S. Cl. ..... 427/235; 205/151; 427/236; 427/239; 427/353; 427/409; 427/412.1; 427/443.1; 427/443.2

[58] Field of Search ..... 427/236, 239, 437, 438, 427/443.1, 443.2, 235, 353, 409, 412.1; 205/151

[56] References Cited

U.S. PATENT DOCUMENTS

| | | | |
|---|---|---|---|
| 2,532,283 | 12/1950 | Brenner et al. | 117/50 |
| 3,011,920 | 12/1961 | Shipley, Jr. | 117/213 |
| 3,424,597 | 1/1969 | Shipley, Jr. | 106/1 |
| 3,702,263 | 11/1972 | Hall et al. | 117/240 |
| 3,709,715 | 1/1973 | Edmunds et al. | 427/236 X |
| 3,947,610 | 3/1976 | Bodmer et al. | 427/142 |
| 4,061,802 | 12/1977 | Costello | 427/304 |
| 4,160,049 | 7/1979 | Narcus | 427/277 |
| 4,368,223 | 1/1983 | Kobayashi et al. | 427/443.1 |
| 4,386,121 | 5/1983 | McCready et al. | 427/236 X |

FOREIGN PATENT DOCUMENTS

| | | |
|---|---|---|
| 893821 | 2/1972 | Canada . |
| 50-14617 | 5/1975 | Japan . |
| 58-104169 | 6/1983 | Japan . |
| 1174461 | 12/1969 | United Kingdom . |

OTHER PUBLICATIONS

"Electroless (Autocatalytic, Chemical) Plating", Jim Henry, *Metal Finishing Guide Book and Directory*, Metals and Plastics Publications Inc., Hackensack, N.J.

*Primary Examiner*—Michael Lusignan

*Attorney, Agent, or Firm*—Eckert Seamans Cherin & Mellott

[57] ABSTRACT

The internal surfaces of a tank for liquids, for example a cargo tank or ballast tank of a ship, are coated by application of a metal plating composition to them by means of an applicator to form a metal layer at least 1 micron thick. The plating composition may be an electroless plating composition or an electroplating composition and is preferably thickened or gelled so that it is thixotropic or does not drip from downwardly facing surfaces.

14 Claims, No Drawings

METAL PLATING PROCESS

FIELD OF THE INVENTION

This invention relates to a composition and method for applying a coating to tanks for liquids, namely large preformed structures which have to be coated in situ rather than by a factory process. Such tanks include cargo tanks in ships for carrying mineral or vegetable oil or chemical products, and land-based tanks for such liquids, and ballast tanks in ships, as well as other large vessels for liquids. Such tanks are usually constructed of mild steel, which is susceptible to corrosion which may contaminate the cargo and to corrosion by some cargoes or by sea water. Tanks are coated to avoid this; examples of widely used tank coatings are those based on thermosetting organic polymers such as epoxy resins and polyurethanes and those based on zinc silicate coatings. The coatings based on epoxy resins and polyurethane are resistant to most but not all organic chemicals carried as bulk cargoes. In particular, they are not resistant to methanol. The zinc silicate coatings are resistant to most organic chemicals carried as bulk cargoes but are not resistant to acids and alkalies.

SUMMARY OF THE INVENTION

In a coating process according to one aspect of the invention, a metal plating composition is applied to the internal surfaces of a tank for liquids by means of an applicator to form a metal layer at least 1 micron thick. The applicator used to apply the plating composition may for example be spraying equipment or a brush, roller or trowel. Such a means of application is distinguished from a coating bath.

The metal plating composition is preferably an electroless plating composition. For coating a tank for liquids, the metal is preferably nickel. In general, electroless nickel plating compositions are aqueous compositions containing a dissolved nickel salt and a reducing agent. A surface, particularly a metal surface, in contact with the electroless nickel plating composition catalyses the reduction of the nickel salt so that nickel metal is plated on a surface.

PRIOR ART

In prior art processes electroless nickel plating is achieved by immersing the object to be plated in a bath of the electroless nickel plating composition. Examples of electroless nickel plating compositions are given in "Metal Finishing Guide Book and Directory" published annually by Metals and Plastics Publications Inc. of Hackensack, N.J. and in U.S. Pat. Nos. 2,532,283, 3,011,920, 4,061,802 and 4,368,223.

U.S. Pat. No. 4,368,223 describes a process for preparing a transparent nickel layer on glass by electroless plating. A glass plate is sprayed with an electroless nickel plating composition and left for 2 minutes to form a transparent nickel layer 0.05 micron thick.

Japanese Patent Application 58-104169 describes a non-electrolytic plating method comprising the step of coating onto a metal or plastics surface, a plating liquid containing a water-soluble binder, a reducing agent and a metal salt or metal complex salt, followed by the step of heating. Japanese Patent 50-14617 describes a high-viscosity non-electrolytic plating liquid characterised by having a viscosity of from 1000 to 300000 mPa s (cps) and containing a compound or mixture which heightens the viscosity of the plating liquid or a compound or mixture which has a high viscosity and which has an extremely small effect on the plating action.

DETAILED DESCRIPTION

In the process according to the invention an adequate time of contact should be ensured between the metal plating composition and the surfaces to which it is applied, particularly when it is applied to a vertical surface or to the underside of a horizontal surface. According to one aspect of the invention the metal plating composition contains a gelling or thickening agent in an amount such that the composition is thixotropic or has a viscosity such that it does not substantially drip from a downwardly facing surface to which it has been applied. The viscosity of the composition is preferably at least 400 kilopascal-seconds at a shear rate of less than 1 $sec^{-1}$, most preferably at least 1000 kilopascal-seconds.

The metal plating composition can be an electroless plating composition, in which case the gelled or thickened composition needs only to be left in contact with the surfaces to be plated, e.g. for from 2 to 48 hours. The metal plating composition can alternatively be an electroplating composition. In this case the gelled or thickened composition is applied to the surface to be plated and an electric current is applied between the said surface as cathode and one or more anodes which are in contact with the gelled or thickened plating composition. Use of an electroplating composition is less convenient because of the need to apply anodes and electrical connections, but the metal can be deposited more rapidly by electroplating than by electroless plating. Moreover, electroplating compositions are more stable than electroless plating compositions and a wider range of metals can be deposited by electroplating.

An alternative method of providing adequate time of contact between an electroless metal plating composition and the surface to be coated is the use of continuous spraying. In this process according to the invention an electroless metal plating composition is sprayed onto the vertical or downwardly facing surfaces of a tank for liquids from a spray head and plating composition which has run down or fallen from the said vertical or downwardly facing surfaces is collected and recirculated through the spray head.

Examples of metals which can be deposited using the electroless coating process of the invention are nickel, copper, cobalt, silver, gold, ruthenium and rhodium. Nickel is the preferred metal for protective tank coatings as described above. Cobalt can also be used for such protective plated coatings. Platinum group metals give higher resistance to corrosive media such as mineral acids but at higher cost. Copper or a mixture of copper and nickel can be coated on ship and boat hulls as an antifouling layer. Any of these metals can alternatively be deposited using an electroplating process, as can other platinum group metals such as platinum or iridium. The substrate which is coated can be a metal surface, for example mild steel, stainless steel, aluminium or a copper alloy, or a synthetic resin surface which can be a painted surface, for example an epoxy resin or polyurethane coating or a shaped thermoplastic or thermoset resin, for example of polycarbonate, thermoplastic polyester such as polyethylene terethphalate, or glass-fibre-reinforced unsaturated (thermoset) polyester resin.

The metal plating composition contains a salt of the metal to be plated, preferably a salt of a strong acid, for example a chloride, sulphate, bromide, iodide, oxalate, sulphamate and/or sulphonate. The salt of a strong acid can be used with a smaller amount of a salt of a weaker acid, for example an acetate or formate. The most preferred salts for electroless nickel plating or for electroplating with nickel are nickel chloride or nickel sulphate. Nickel fluoborate, Ni $(BF_4)_2$, can be used for electroplating. The concentration of metal salt in the plating composition is preferably at least 0.2 molar up to a saturated solution, most preferably 0.5–3.0 molar. The electroless nickel compositions most preferably contain 20 to 200 grams nickel per liter. If the metal salt has a relatively low solubility, excess metal salt in finely divided solid form can be incorporated in the plating composition so that as metal is plated from the gelled or thickened composition the solid salt is gradually dissolved into the composition.

The preferred reducing agent for use with nickel in an electroless plating composition to form protective coatings is a hypophosphite, preferably an alkali metal hypophosphite such as sodium hypophosphite $NaH_2PO_2$. Use of hypophosphite causes plating with a nickel/phosphorus alloy containing for example 1 to 15 per cent by weight, especially 7 to 11 per cent, phosphorus. Such nickel/phosphorus alloys have an excellent combination of corrosion resistance, hardness and chemical resistance. Alternative reducing agents are organoboron, borane or borohydride reducing agents such as sodium borohydride, tertiary butyl amine borane or tetraborane $B_4H_{10}$ which when used with nickel give very hard nickel/boron alloys. Hydrazine, hydrazinium sulphate, glyoxal or metallic hydrides such as sodium hydride or an aluminium hydride such as sodium or lithium aluminium hydride can be used. The concentration of reducing agent in the plating composition is preferably 10 to 300 grams per liter, particularly 50 to 200 grams per liter. When a hypophosphite reducing agent is used the weight ratio of nickel to hypophosphite is preferably 1:1 to 1:10, especially 1:2 to 1:5.

The electroless plating composition preferably contains a complexing agent for the metal to be plated. The complexing agent contains donor groups which form a coordination bond to metal. The complexing agent increases the rate of deposition of metal from the plating composition, tends to reduce porosity of a plated nickel layer and improves solution stability. The donor groups should not form such a strong coordination bond that the metal is prevented from plating out of the composition. For example, when the metal to be plated is nickel the complexing agent should complex with nickel more strongly than ammonia does but less strongly than ethylene diamine tetraacetic acid does. The complexing agent is preferably multidentate. Compounds or ions containing hydroxyl and/or carboxylate groups can be used, for example lactic, citric, tartaric, acetic or glycolic acid, 1,3-acetone-dicarboxylic acid or beta-alanine, or a water-soluble salt of any of these acids, for example a sodium, potassium, ammonium or calcium salt. A crown ether can alternatively be used. The complexing agent is preferaby used at a weight ratio of 1:10 to 10:1 with respect to the nickel in an electroless nickel plating composition.

An electroless nickel plating composition can have either an alkaline or an acid pH. An alkaline pH of for example 8 to 10 is preferred. Plating at alkaline pH gives more rapid deposition at ambient temperature than plating at acid pH. The pH can be adjusted with ammonium hydroxide or an alkali such as sodium hydroxide or potassium hydroxide. An acid pH of 4 to 6 can alternatively be used. A buffering agent can be used to control pH. Tris(hydroxymethyl) methylamine, potassium hydrogen phthalate, N,N-bis(2-hydroxyethyl)glycine and sodium or potassium phosphates or borates are examples of buffering agents that can be used at alkaline pH. At acid pH many of the compounds which can be used as complexing agents also act as buffering agents. The plating composition can also contain a stabiliser to prevent plating out of metal within the gel. A sulphur compound such as thiourea is a suitable stabiliser for an alkaline electroless nickel plating composition.

An electroplating composition to be used according to the invention need only contain a salt of the metal to be plated, for example nickel chloride or sulphate, and a gelling or thickening agent. The electroplating composition preferably however contains a buffering agent such as boric acid and may contain an anti-pitting agent such as hydrogen peroxide or an anionic surfactant such as sodium lauryl sulphate.

The gelling or thickening agent can be inorganic, for example a pyrogenic silica, or organic, for example a polysaccharide. A suitable pyrogenic silica is sold under the trade mark "Aerosil 200" and is preferably used at 4 to 8 per cent by weight of the plating composition. Examples of suitable polysaccharide gelling or thickening agents are cellulose ethers such as methyl cellulose, hydroxypropyl methyl cellulose, hydroxyethyl cellulose, ethyl cellulose or sodium carboxymethyl cellulose, which are preferably used at 1 to 4 per cent by weight, alginic acid or a salt thereof such as sodium alginate, which is preferably used at 1 to 3 per cent by weight, gum arabic which is preferably used at 10 to 15 per cent by weight, gum karaya which is preferably used at 1 to 3 per cent by weight, agar which is preferably used at 2 to 10 per cent by weight, guar gum or hydroxypropyl guar gum which are preferably used at 1 to 10 per cent by weight, or locust bean gum which is preferably used at 2 to 5 per cent by weight. Polysaccharides made by microbial fermentation can be used, for example xanthan gum or those sold under the Trade Marks "Shellflo-XA" or "Shellflo-S". Mixtures of polysaccharides can be used and may be advantageous in giving a low shear viscosity which is temperature stable. An alternative organic gelling agent is gelatin, for example of Bloom 175 or Bloom 300, which is preferably used at 2 to 7 per cent by weight. Synthetic polymeric gelling or thickening agents such as polymers of acrylamide or acrylic acid or salts thereof, e.g. polyacrylamide, partially hydrolysed polyacrylamide or sodium polyacrylate, or polyvinyl alcohol can alternatively be used. The gelling agent may be a polymer which is crosslinked by the plating metal to form a gel; for example a polymer of crotonic acid or of acetoacetoxyethyl acrylate can be cross-linked by nickel in aqueous solutions to form a gel. The thickening or gelling agent preferably produces a thixotropic or shear-thinning gel so that the electroless nickel plating composition can be sprayed but gels on the surface to be coated. In such a thixotropic or shear-thinning gel the viscosity is preferably 1–10 pascal-seconds at shear rates above 10 $sec^{-1}$.

An electroless nickel plating composition can include minor amounts of other metals in water-soluble salt form, for example copper, tin, cobalt, chromium, molybdenum or rhenium. Such metals are co-deposited with the nickel to form alloy coatings which may have additional properties. For example a nickel/copper alloy may give enhanced resistance to biological fouling when carrying water, for example sea-water ballast, or aqueous cargoes. A coating of an alloy of nickel with tungsten, chromium, molybdenum or rhenium may have enhanced resistance to corrosion. Some metals, for example cobalt or chromium, can be co-deposited with nickel from an electroplating composition.

The plating composition can also contain an anti-foaming agent, for example benzoin or 2-propanol. A hydrophobic oil can be included to reduce the rate of evaporation of water from the gel which is on the substrate; the hydrophobic oil will migrate to the outer surface of the gel and act as a barrier layer.

The surface of the substrate to be coated may be pretreated with a chemical activator before an electroless plating composition is applied. Chemical activators are particularly effective when used in conjunction with alkaline electroless nickel plating compositions at ambient temperature, for example 10° to 40° C. Chemical activators are described for example in U.S. Pat. Nos. 2,532,283, 3,011,920 and 4,061,802. A preferred chemical activator solution contains a palladium salt, which may be used alone or in conjunction with a tin compound such as stannous chloride. The activator solution can for example contain 0.001 to 0.1 per cent by weight palladium chloride, $PdCl_2$. The activator solution is preferably acidic. Colloidal copper is an alternative activator. The activator solution can for example be sprayed on the surfaces of the vessel which are to be coated. The activator solution need not be thickened or gelled. Activator treatment is generally necessary for plating on plastics substrates but is generally not necessary for plating on metal, e.g. steel, substrates.

When the plating composition is applied in thickened or gelled form it is generally preferred to use a composition effective at ambient temperature since it may be difficult to maintain the composition at high temperature after it has been applied to the surface of the tank. Alternatively the electroless plating composition can be applied by continuously recirculated spray, in which case the composition can be applied at higher temperatures. A heating device can be included in the feedline to the spray equipment. In this case an electroless nickel plating composition which is mainly effective at higher temperatures, for example 60° to 100° C., can be used, particularly an acidic plating composition. A gelled or thickened composition can also be applied by heated spray. It may be possible to maintain the gel coating at elevated temperature by heating the substrate or by an exothermic reaction in the gel. It may be advantageous to maintain a high relative humidity around the thickened or gelled plating composition after it has been applied to a surface (where this is possible, for example when coating the internal surfaces of a tank) to reduce evaporation of water from the composition.

The thickened or gelled plating compositions are preferably applied by spray, for example airless spray or rotating disc or plate electrostatic spray, but can alternatively be applied by brush, roller or trowel. In many cases the bulk of the surface can be sprayed, with particularly rough or inaccessible surfaces, for example welds, being touched up by brush.

When the gelled or thickened metal plating composition applied to the substrate is an electroplating composition, an electric current is passed between the substrate as cathode and one or more anodes which are in contact with the gel coating. The anodes are preferably flexible carbon anodes which can be moved across the surface of the gel coating, for example anodes of the type used in brush plating. The current applied is similar to the currents generally used in electroplating baths.

The thickness of the metal plating applied according to the invention is generally at least 3 microns. When depositing nickel as a protective coating, e.g. for tanks, the nickel coating formed is preferably at least 7 microns thick to ensure a continuous nickel surface. For example the nickel coating may be 7 to 150 microns, most preferably 15 to 40 microns, thick. To achieve such nickel layers the gelled or thickened nickel plating composition should be applied to the surface of the vessel at a thickness of 0.3 to 10 millimetres, preferably 1 to 5 millimetres.

The rate of deposition of the metal from an electroless metal plating composition depends on the stability of the electroless plating composition and on temperature. More stable plating compositions generally deposit metal at a slower rate but form a harder and more adherent and chemically resistant coating. Plating rates of 0.2 to 5 microns per hour may be satisfactory when applying a gelled or thickened electroless nickel plating composition at ambient temperature. It may for example be convenient to leave the gelled plating composition in contact with the surface of the vessel overnight. When the plating composition is applied at higher temperatures, higher plating rates, for example of 2 to 20 microns per hour, can give satisfactory coatings.

When a gelled or thickened composition is used it is necessary to remove the gel from the surface after plating is completed. Washing with water, optionally containing conventional detergents, is generally effective and does not harm the nickel plating. The resulting dilute aqueous solution is removed from the tank. When plating a ship's tank the dilute solution can be removed using the apparatus for discharging cargo from the tank.

The gelled or thickened plating composition can be applied in successive coats. For example, 2 to 5 coats of a gelled electroless nickel plating composition can be applied to the surface of a tank, with each coat being left in contact with the surface for 2 to 48 hours, preferably 2 to 12 hours. Successive coats of different plating compositions can be applied. For example, an initial coat of a copper/nickel alloy can be plated with one or more coats of nickel. A nickel and/or copper coating applied in one or more plating steps can be plated with a thin layer (for example 0.01–1 micron) of a precious metal to give enhanced resistance to aqueous acid. A nickel or nickel/phosphorus coating can be plated with a layer of a nickel/chromium alloy.

Examples of chemical cargoes which can be carried in tanks plated with nickel according to the invention include alcohols such as methanol, ethanol, amyl alcohol and benzyl alcohol, water and aqueous solutions such as saturated brine, saturated ammonium sulphate, 50 per cent calcium chloride, and 73 per cent sodium hydroxide, ketones such as acetone, esters such as ethyl acetate or amyl acetate, organic acids such as cresylic acid or oleic acid, benzyl chloride, carbon disulphide, carbon tetrachloride, formaldehyde, oil products such as petrol or petroleum white oil, vegetable oils such as tall oil or palm oil, aqueous urea solutions and beverages such as beer. The nickel coatings can also withstand successive use of different cargoes chosen from the above, including methanol used alternately with other chemical cargoes which is a particular problem for organic coatings. The nickel plating produced according to the invention can also be used in ballast tanks to prevent corrosion of the steel tank by sea water. In this case the nickel can if desired be overcoated by an organic coating.

If a tank plated with nickel according to the invention is to be used for carrying aqueous cargoes as well as organic liquids as described above, the tank may be equipped with a cathodic protection system. The nickel-coated tank can then be used to carry aqueous acidic cargoes such as orange juice or dilute aqueous acids such as acetic, boric, citric, hydrochloric or sulphuric acids without damage to the nickel plating or to the underlying steel tank. Cathodic protection is preferably achieved through an impressed current system which is applied to the tank. The impressed current need only be applied when the tank contains an aqueous material, for example an aqueous acidic cargo as described above or an inorganic salt solution.

The invention is illustrated by the following Examples:

EXAMPLE 1

A thixotropic electroless nickel plating composition was prepared having the following composition:

| | |
|---|---|
| $NiSO_4.6H_2O$ | 25 g |
| $NiCl_2.6H_2O$ | 60 g |
| beta-alanine | 90.5 g |
| $NH_4Cl$ | 101 g |
| $NaH_2PO_2$ | 90 g |
| Sodium carboxymethyl cellulose | 27 g |
| Thiourea | 0.003 g |
| $NH_4OH$ | to pH 8.5 |
| Water | to 1 liter |

This composition was sprayed onto a steel plate at a thickness of 3 millimetres. The plate was held in a vertical position for 5 hours. Throughout this time the gelled plating composition remained adhered to the plate and did not run down the plate. The ambient temperature was about 20° C. At the end of the time the gelled plating composition was washed from the plate by water. A hard adherent coating of nickel/phosphorus alloy remained on the plate; this coating was approximately 0.7 micron thick. A further batch of the thixotropic electroless nickel plating composition was sprayed onto the nickel-coated surface and the coated plate was again held in a vertical position for 5 hours before being washed with water. Four such applications of the thixotropic electroless nickel plating composition were made in all to build up a hard adherent coating of nickel/phosphorus alloy 8 microns thick.

EXAMPLE 2

A thixotropic nickel electroplating composition has the following composition:

| | |
|---|---|
| $NiSO_4.6H_2O$ | 250 g |
| $NiCl_2.6H_2O$ | 45 g |
| Boric acid | 30 g |
| Sodium carboxymethyl cellulose | 27 g |
| Water | to 1 liter |

This can be sprayed on a steel surface and treated with flexible carbon anodes, which are electrically connected to the steel as cathode and which are moved across the gel surface to effect deposition of the nickel.

What is claimed is:

1. A coating process for internal surfaces of a tank for liquid cargo or ballast, in which process a metal plating composition is applied to said internal surfaces by means of an applicator to form a metal layer at least one micron thick, wherein said metal plating composition contains a gelling or thickening agent in an amount such that said composition is thixotropic or has a viscosity such that it does not substantially drip from a downwardly facing surface to which it has been applied.

2. A coating process for internal surfaces of a tank for liquid cargo or ballast, in which process an electroless metal plating composition is applied to said internal surfaces by means of an applicator to form a metal layer at least one micron thick, wherein said electroless metal plating composition contains a gelling or thickening agent in an amount such that said composition is thixotropic or has a viscosity such that it does not substantially drip from a downwardly facing surface to which it has been applied.

3. A process according to claim 1 in which said metal plating composition is an electroless plating composition and the gelled or thickened plating composition is left in contact with the surfaces for 2 to 48 hours and is then removed by washing with water.

4. A process according to claim 3 in which said electroless plating composition is a nickel plating composition comprising a dissolved nickel salt, a reducing agent and the gelling or thickening agent.

5. A process according to claim 4 in which said reducing agent is a hypophosphite.

6. A process according to claim 3 in which said metal plating composition contains a complexing agent having donor groups which form a coordination bond to the metal.

7. A process according to claim 2 in which said tank for liquids is a cargo tank or ballast tank of a ship.

8. A process according to claim 1 in which said gelling or thickening agent is a pyrogenic silica.

9. A process according to claim 1 in which said gelling or thickening agent is polysaccharide.

10. A process according to claim 1 in which said gelling or thickening agent is a synthetic polymer selected from the group consisting of polymers of acrylicamide or acrylic acid salts of said polymers, and polyvinyl alcohol.

11. A process according to claim 1 in which said gelling or thickening agent is a polymer which is crosslinked by the plating metal to form a gel.

12. A process according to claim 1 in which said metal plating composition has a viscosity of at least 400 kilopascal-seconds at a shear rate of less than 1 second$^{-1}$ and a viscosity of 1 to 10 pascal-seconds at shear rates above 10 seconds$^{-1}$.

13. A process according to claim 1 is which successive coats of the gelled or thickened plating composition are applied to said surfaces.

14. A process according to claim 1 in which successive coats of different gelled or thickened plating compositions are applied to said surfaces to form a metal coating having layers of different composition.

* * * * *